US008259035B2

(12) United States Patent
Montheard et al.

(10) Patent No.: US 8,259,035 B2
(45) Date of Patent: Sep. 4, 2012

(54) DISPLAY DEVICE ABLE TO OPERATE IN LOW POWER PARTIAL DISPLAY MODE

(75) Inventors: Anne Montheard, Champagne (CH); Joachim Grupp, Enges (CH); Jean-Claude Martin, Montmollin (CH)

(73) Assignee: The Swatch Group Research and Development, Ltd., Marin (CH)

( * ) Notice: Subject to any disclaimer, the term of this patent is extended or adjusted under 35 U.S.C. 154(b) by 841 days.

(21) Appl. No.: 12/405,886

(22) Filed: Mar. 17, 2009

(65) Prior Publication Data

US 2009/0237335 A1 Sep. 24, 2009

(30) Foreign Application Priority Data

Mar. 17, 2008 (EP) ..... 08152848

(51) Int. Cl.
*G09G 3/18* (2006.01)

(52) U.S. Cl. ..... 345/50; 345/95

(58) Field of Classification Search ..... 345/50, 345/95

See application file for complete search history.

(56) References Cited

U.S. PATENT DOCUMENTS

| | | | | |
|---|---|---|---|---|
| 4,608,558 | A | 8/1986 | Amstutz et al. | |
| 4,770,502 | A | 9/1988 | Kitazima et al. | |
| 5,920,301 | A * | 7/1999 | Sakamoto et al. | 345/96 |
| 6,252,571 | B1 * | 6/2001 | Nomura et al. | 345/95 |
| 6,262,704 | B1 | 7/2001 | Kurumisawa et al. | |
| 6,882,332 | B2 | 4/2005 | Zeiter et al. | |
| 2002/0135551 | A1 | 9/2002 | Zeiter et al. | |
| 2005/0068257 | A1 * | 3/2005 | Stephenson et al. | 345/50 |
| 2005/0206586 | A1 * | 9/2005 | Capurso et al. | 345/50 |
| 2007/0097025 | A1 * | 5/2007 | Itoh et al. | 345/50 |

FOREIGN PATENT DOCUMENTS

| | | |
|---|---|---|
| EP | 0 106 386 | 4/1984 |
| EP | 0 229 647 | 7/1987 |
| EP | 0 617 397 | 9/1994 |
| EP | 0 811 866 | 12/1997 |
| EP | 1 213 700 | 6/2002 |

OTHER PUBLICATIONS

European Search Report issued in corresponding application No. EP 08 15 2848, completed Sep. 24, 2008. "Some new addressing techniques for RMS responding Matrix", drawn from a thesis by M. T. N. Ruckmongathan, of the Dept. Electrical Comm. Eng. Indian Institute of Science, Bangalore, Karnataka, Feb. 1988, http://dspace.rri.res.in/dspace/handle/2289/3499>.

T. J. Scheffer and B. Clifton, "Active Addressing Method for High-Contrast Video-Rate STN Displays", SID, 1992, pp. 228-231.

* cited by examiner

*Primary Examiner* — Kevin M Nguyen
*Assistant Examiner* — Sepideh Ghafari
(74) *Attorney, Agent, or Firm* — Griffin & Szipl, P.C.

(57) ABSTRACT

The display device includes a display cell including liquid crystals and a matrix of electrodes arranged in lines and columns in a closed cavity. The lines and columns define display cell pixels. The display device includes a control circuit for lines and columns for display of data on the display cell. In complete display mode, all lines and columns are addressed at several voltage levels by successive line-by-line multiplexing. In low power partial display mode, two groups of adjacent lines are joined so they are each controlled by a respective line control signal from the control circuit. The N lines and groups of lines are simultaneously addressed in active manner at two voltage levels. N line control signals include a series of N-bit binary line words that change every determined period of time, T, so $2^N$ combinations of binary line words are present in each successive cycle of length $2^N \cdot T$.

17 Claims, 5 Drawing Sheets

Fig. 2
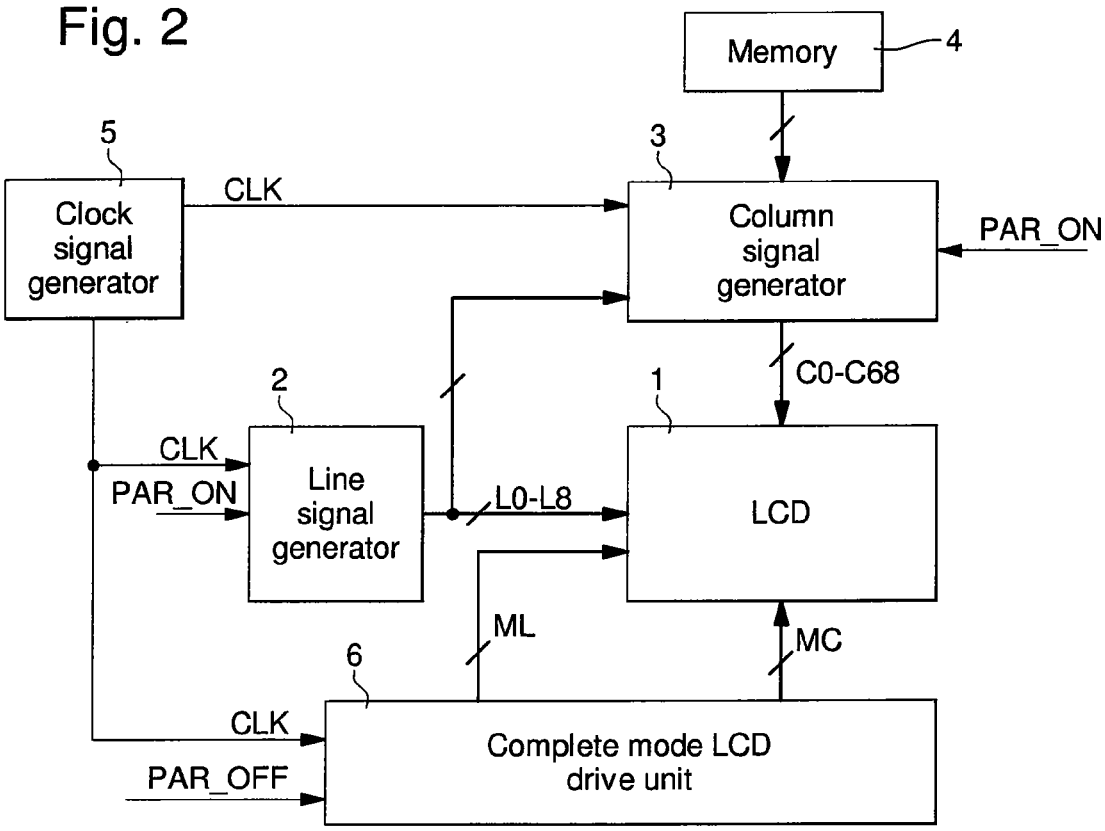
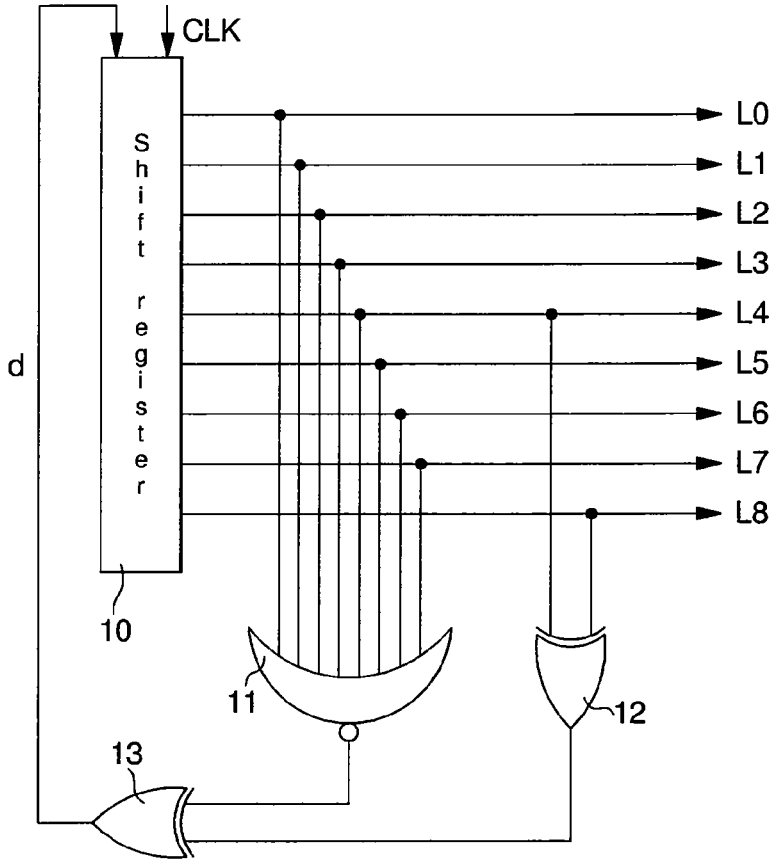
Fig. 3

DISPLAY DEVICE ABLE TO OPERATE IN LOW POWER PARTIAL DISPLAY MODE

This application claims priority from European Patent Application No. EP08152848.1 filed Mar. 17, 2008, the entire disclosure of which is incorporated herein by reference.

FIELD OF THE INVENTION

The invention concerns a display device, for example of the LCD type, able to operate in low power partial display mode. The display device includes a display cell, which includes a bottom substrate, a transparent top substrate, a sealing frame for the substrates that defines a closed cavity containing a substance whose optical properties change in the presence of an electric field, and a matrix of electrodes arranged in lines and columns. The lines can be placed on a first inner face of one of the substrates, whereas the columns can be placed on a second inner face of the other substrate to define pixels of the device between the lines and columns. The device also includes a line and column control circuit for displaying information on the display cell. In complete display mode, all of the lines and columns are addressed at several voltage levels by multiplexing the lines in succession, line by line.

BACKGROUND OF THE INVENTION

In a passive matrix LCD display device, the lines and columns of the display cell are controlled by a conventional control or drive circuit. The number of lines is generally less than the number of columns. The pixels of each column are addressed one after the other by line-by-line multiplexing. The pixel is off between two refreshing operations. Normally, when the dimensions of the display device are large, an active matrix LCD display device is used.

For a display device with a display cell of large dimensions, one could envisage configuring the display device so that it uses only an active part of the cell in partial display mode, in order to reduce the electrical consumption of the device in the partial mode. EP Patent Application No. 0 811 866, which discloses a method of driving a display device so as to reduce the electric power consumption thereof, can be cited in this regard. To achieve this, part of the inactive lines and columns of the matrix are placed at a defined voltage. Lines and columns of the active part are, however, addressed in succession in a conventional manner, particularly by multiplexing, for the display of data.

One drawback of this solution disclosed in EP Patent Application 0 811 866 is that, in complete display mode or in partial display mode, several voltage levels must be used to display data. These different voltage levels have to be obtained by at least one voltage booster circuit. This means that the electric power consumption cannot be sufficiently reduced even in partial display mode, since line-by-line multiplexing at different voltage levels has to be performed.

Instead of multiplexing the lines, an addressing method was disclosed in the article entitled "Active Addressing Method for High-Contrast Video-Rate STN Displays", in SID 1992, by Messrs T. J. Scheffer and B. Clifton. The object of the method disclosed is to overcome problems linked to LCD display devices, which are always quicker. The principle is to apply orthonormed functions to the lines and calculate the values on the columns as a function of the values to be displayed by the pixels and the values on the lines. However, this article does not disclose the means of making a display device able to operate at low power as for the present invention.

EP Patent Application 0 617 397 discloses a liquid crystal display device of large dimensions. Several line drive circuits drive several lines of this display device individually and simultaneously with voltages determined in accordance with Walsh functions. However, nothing is specified regarding a reduction in power consumption upon passage from complete display mode to partial display mode, in which an active addressing technique can be used.

SUMMARY OF THE INVENTION

It is therefore an object of the invention to overcome the aforementioned drawbacks of the state of the art by providing a display device that can operate in partial display mode with low voltage line and column addressing in order to reduce the power consumption of the device in partial display mode.

The invention therefore concerns the aforecited display device, which includes, in accordance with a first embodiment of the invention, display device including a display cell, which includes a bottom substrate, a transparent top substrate, a frame sealing the substrates defining a closed cavity in which there is a substance, whose optical properties change in the presence of an electric field, and a matrix of electrodes arranged in lines and columns inside the cavity to define the display cell pixels, wherein the device also includes a control circuit for the lines and columns for displaying data on the display cell, and in complete display mode all of the lines and columns are addressed at several voltage levels by successive line-by-line multiplexing, wherein in low power partial display mode, at least one group of lines is connected so as to be controlled by the same line control signal from the matrix control circuit, and wherein the lines of an active zone of the display cell and the group of lines are addressed simultaneously by an active addressing technique at two voltage levels, wherein a first voltage level defines logic level 0 and a second voltage level defines logic level 1, wherein the second voltage level is higher than the threshold voltage of the display device, but less than two times higher than the threshold voltage.

Particular embodiments of the display device are defined in additional embodiments as follows. In accordance with a second embodiment of the present invention, the display device according to the first embodiment is modified so that, in partial display mode, at least one group of columns is connected so as to be controlled by a same column control signal from the control circuit, and wherein the column control signals of the active zone and of the group of columns are each determined on the basis of the N line control signals, compared, in one complete cycle, to an N-bit binary data word representative of the state of the pixels of each column. In accordance with a third embodiment of the present invention the first embodiment is modified so that the lines are placed on a first inner face of one of the substrates, wherein the columns are placed on a second inner face of the other substrate and arranged perpendicularly to the lines so as to define pixels of the passive matrix display cell, and wherein the display cell includes N' lines and M" columns, where the number of lines N', which may be higher than 11, is less than the number of columns M', which may be higher than 69, for the complete display mode of the display device.

In accordance with a fourth embodiment of the invention, the second embodiment is further modified so that the number of lines and group of lines actively addressed in partial display mode is an integer number N comprised between 3 and 11. In accordance with a fifth embodiment of the present invention, the fourth embodiment is further modified so that the number N is an odd number.

In accordance with a sixth embodiment of the invention, the first embodiment is modified so that in partial display mode, a number N of lines and groups of lines is simultaneously controlled by N line control signals, which include a series of N-bit binary line selection words, which change every determined period of time, T, so that all of the binary line word combinations, i.e. $2^N$ different binary words, are present in each successive cycle of length $2^N \cdot T$. In accordance with a seventh embodiment of the invention, the first, second, third, fourth, fifth and sixth embodiments are further modified so that two groups of adjacent lines are formed in partial display mode with the lines of an active zone arranged between the two groups of connected lines. In accordance with an eighth embodiment of the invention, the first embodiment is modified so that two groups of adjacent columns are formed in a partial display mode with the columns of an active zone arranged between the two connected groups of columns.

In accordance with a ninth embodiment of the invention, the first, second, third, fourth, fifth and sixth embodiments are further modified so that in low power partial display mode, N line control signals are generated simultaneously by a line control signal generator, clocked by a clock signal, supplied by a clock signal generator. In accordance with a tenth embodiment of the present invention, the ninth embodiment is further modified so that the line control signal generator includes a shift register for storing an N-bit binary word and supplying N line control signals, a NOR logic gate for adding the first N−1 bits and supplying an inverse signal, a first EXCLUSIVE-OR logic gate for adding two of the N different bits, and a second EXCLUSIVE-OR logic gate for adding together the output of the NOR gate and the output of the EXCLUSIVE-OR gate so as to supply data to the shift register to be inserted at each clock signal.

One advantage of the display device according to the invention lies in the fact that, in partial display mode, it uses active addressing of all the lines, thus all of the lines are active and not multiplexed one after the other. The line control signals, and the column control signals, obtained on the basis of the line control signals, only have two voltage levels. A first voltage level, corresponding for example to zero voltage, is defined by a logic state 0. A second voltage level, corresponding to a voltage that is two times greater than the threshold voltage of the display device, is defined by a logic state 1. A voltage booster circuit is not, therefore, necessarily required for active line addressing. This thus enables the electric power consumption of the display device to be greatly reduced in partial display mode, which means the device can then be fitted to a portable object, such as an electronic wristwatch powered by a battery of small dimensions.

Advantageously, owing to active addressing of the display cell lines, some of which are short-circuited to form at least one group of lines in partial mode, the continuous voltage component is intrinsically removed. The control signals are also simple to generate. This is different from conventional addressing via multiplexing, where the succession of line addressing cycles has to be alternated every other cycle with identical impulse cycles of opposite polarity to remove the continuous voltage component. However, the display device can be switched to operate either in complete display mode, or in partial mode.

In partial display mode, in order to define an active display zone of at least one line of characters, some columns may also be short-circuited to form at least one group of columns. With the groups of lines and columns thereby formed, this can reduce the working frequency in this partial display mode.

Advantageously, active addressing of the display device in low power partial mode can be based on the addressing method disclosed, in particular, in the article entitled, "Some new addressing techniques for RMS responding Matrix", drawn from a thesis by M. T. N. Ruckmongathan, of the Dept. Electrical Comm. Eng. Indian Institute of Science, Bangalore, Karnataka in 1988. To achieve this, the number N of lines to be actively addressed, wherein one addressed line includes at least one group of short-circuited lines, has to be reduced so that the display device still has sufficient contrast. This number N, which must be an odd number, may be comprised between 3 and 11.

The method of the above article thus derives from active addressing. To achieve this, a word of N bits is chosen for the N lines, which includes the group of connected or joined lines, with the two aforementioned voltage levels. The N-bit word changes at each period of time T defined by clock pulses, in order to form ortho-normal functions in one complete cycle. In each successive active-addressing cycle, all of the combinations of N-bit binary words must thus be chosen. There must be $2^N$ combinations, for each cycle of length $2^N \cdot T$.

Advantageously, the succession of binary words in the simultaneous addressing of N lines is used to determine the column control signals. To do this, a binary data word in each column is compared bit-by-bit with each successive line-addressing binary word. This comparison is carried out by means of digital comparators, for example by EXCLUSIVE-OR (XOR) gates. The number of differences for each binary line-addressing word is counted and compared to a threshold. The voltage level applied to the column corresponds to the first voltage level, i.e. the logic state 0 if the number resulting from all the comparisons is less than N/2. The voltage level for the column corresponds, however, to the second voltage level, i.e. logic state 1, if the number resulting from the comparisons is higher than N/2. The column control signals are thus defined for each successive cycle for the 2N combinations of binary line words.

BRIEF DESCRIPTION OF THE DRAWINGS

The objects, advantages and features of the display device will appear more clearly in the following description on the basis of at least one non-limiting example illustrated by the drawings, in which:

FIG. 2 shows, in a simplified manner, a flow diagram of the electronic elements of the display device according to the invention, FIG. 3 shows one embodiment of the line control signal generator for active addressing of the display device according to the invention.

DETAILED DESCRIPTION OF THE INVENTION

In the following description, all those elements of the display device that are well known to those skilled in the art in this technical field are related only in a simplified manner. Reference is made mainly to a liquid crystal display device for use in a watch, although the configuration of the device in the partial display mode may be applied to any other type of display device.

Figure 1:
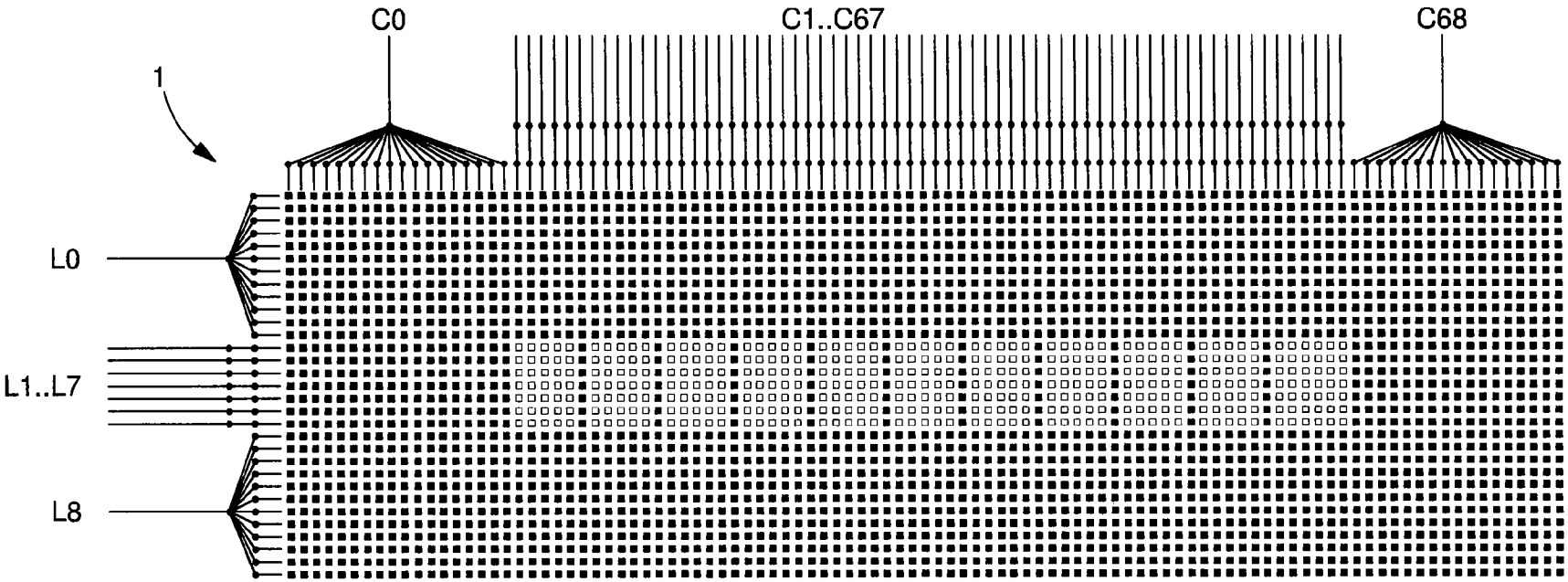
FIG. 1 shows a simplified top view of the display cell of the display device according to the invention showing the active zone and the short-circuited lines and columns.

FIG. 1 shows a top view of the display cell 1 of the display device, which is of the liquid crystal type. Not shown in FIG. 1, display cell 1 is formed of a bottom substrate that may or may not be transparent, a transparent top substrate, and a frame sealing the substrates to define a closed cavity. A substance, whose optical properties change in the presence of an electric field, is placed in the closed cavity.

In this embodiment, display cell 1 also includes an electrode matrix for defining the display cell pixels. The matrix lines are arranged on an inner face of one of the substrates, whereas the matrix columns are arranged on an inner face of the other substrate, opposite and perpendicular to the lines. Orientation of the substance crystals for a pixel is obtained by a potential difference, higher than the display cell threshold voltage, applied between one column, opposite a line.

In this embodiment, display cell 1 includes, for the display device complete display mode, N' lines, such as 31 lines, and M' columns, such as 101 columns. This defines N'×M' pixels of a large display cell. When the display device is configured in partial display mode, several lines are connected or joined, by being short-circuited, as well as several columns.

As shown in FIG. 1, there is a first group of short-circuited lines L0, a second group of short-circuited lines L8, a first group of short-circuited columns C0 and a second group of short-circuited columns C68. These groups of lines and columns define an inactive zone of the display cell, whereas the other lines L1 to L7 and the other columns C1 to C67 define an active zone of the display device. The active zone must be able to display at least one line of characters in partial display mode.

It should be noted that in the partial display mode of the display device, the lines and groups of lines are actively addressed as explained below, with only two voltage levels. A first voltage level may be zero voltage, which corresponds to logic state 0. A second voltage level Vs may be a voltage of higher value than the threshold voltage Vth of the liquid crystal display cell, which corresponds to logic state 1. All of the lines in this partial mode are simultaneously addressed and not multiplexed as in complete display mode. The two groups of lines L0 and L8 can each be considered like another line L1 to L7 of the active zone for active addressing, since in this partial mode both the lines of the active zone and the two groups of lines are simultaneously addressed by a respective control signal.

The addressing method suited to the display device in low power partial mode is that described, in particular, in the article entitled, "Some new addressing techniques for RMS responding matrix" drawn from a thesis by M. T. N. Ruckmongathan, of the Dept. Electrical Comm. Eng. Indian Institute of Science, Bangalore, Karnataka in 1988. For further information relating to this active addressing method, the reader may refer mainly to pages 3.1 to 3.18 of chapter 3 of this article.

With this active addressing method, the number of lines and groups of lines to be addressed has to be reduced in partial mode. This number is equal to N, where N is an integer number, for example between 3 and 11, and for example equal to 9 like the references L0 to L8 shown in FIG. 1. According to the active addressing principle described, the number N must, in theory, be an odd number. Thus, only first and second voltage levels have to be generated. Preferably, zero voltage is used for the first voltage level and a voltage Vs, whose value is greater than the threshold voltage of the display cell, is used for the second voltage level.

With a number N of lines and groups of lines equal to 9, the value of this voltage for defining a logic state 1 is 1.659·Vth, where Vth is the threshold voltage of the liquid crystal cell. By way of comparison, in a standard multiplexed method, the number of voltages to be generated may be at least 3, or even higher, with a voltage defining a logic state 1 equal to 3.46·Vth for a number of lines equal to 9. This favours the use of the active addressing technique if the number of lines is reduced relative to a conventional multiplexed addressing technique.

It should also be noted that the control signals applied to the lines and columns alternate so to obtain an alternating polarising voltage for each pixel for the display of data. If only constant voltage is applied between a line and a column to define the state of a pixel, electrochemical reactions may occur, which tend to shorten the lifetime of the display cell.

With an alternating voltage, a sufficient root mean square voltage RMS must be taken into account in each cycle, which is well known in the state of the art. This RMS value must be able to define a pixel in the OFF state with a low polarising voltage or a pixel in the ON state with sufficient polarising voltage, higher than the threshold voltage Vth of the display cell. Because of this mean RMS voltage, an error can be tolerated, given that a root mean square is performed on each cycle to define the polarising voltage of each pixel.

The drive voltage frequency must be at least 30 Hz to prevent the display from flickering. A too high frequency leads, by coupling, to relaxation effects, which cause irregular residual contrast in the display. The highest frequency limit is approximately 200 Hz. Current consumption increases normally in direct proportion to the drive frequency.

In order to understand active addressing in the partial display mode of the display device, reference must be made to the means for generating each active column voltage for defining the column control signals. First of all, as previously mentioned, there are only two voltage levels for defining logic states 0 and 1. A digital addressing technique is used in the partial mode, which is a totally different approach from the conventional multiplexing of a matrix display device based on line-by-line addressing.

All of the N lines or groups of lines L0 to L8 are simultaneously addressed via this active addressing method. Thus, as explained more simply below with reference to FIGS. 3 and 4, the control signals for the columns or groups of columns C0 to C68 are determined on the basis of the N control signals of the lines and each N-bit binary data word of the state of the pixels of each column for the display of data.

The N line control signals include a series of N-bit line selection binary words, which change every period of time T as a function of the clocking operation performed by a clock signal CLK. All of the combinations of binary line words in each successive cycle must be selected in accordance with a pseudo-random principle obtained via a line signal generator. For a number N of lines and groups of lines, there must be $2^N$ different binary words in each cycle of length to equal to $2^N \cdot T$.

The data to be displayed in a column is an N-bit data word, where each piece of data has a value of 0 for an OFF pixel or 1 for an ON pixel. The line selection voltages are selected to be 0 for logic state 0 and Vs for logic state 1. In each period of time T, the binary data and line selection words are compared bit-by-bit using digital comparators, for example EXCLUSIVE-OR (XOR) gates. The number of alignment errors i between these two binary words is determined by counting the number of EXCLUSIVE-OR gates with an output equal to 1. The voltage of each column Vc is decided by a majority decision for each period T in order to obtain each column control signal. The column voltage is 0 if number i is less than N/2 and is Vs if number i is greater than N/2. To prevent number i being equal to N/2, the number of lines must be an odd number.

The period of time T of each change of binary line word should be small compared to the response time of the display cell to ensure proper RMS behaviour of the display. The length of one cycle, which is equal to $2^N \cdot T$, should also be small to prevent flickering in the display.

The mean RMS voltage value through the pixels is independent of the sequence in which the $2^N$ binary line selection words are selected for addressing the display. This allows complete freedom in the choice of the sequence to be adapted to the display features.

The display device according to the present invention includes the various electronic elements shown schematically in FIG. 2. The display device includes first of all a display cell 1, which may be a liquid crystal cell (LCD) with a passive electrode matrix, and a control circuit for the lines and columns of the display cell matrix. The control circuit may be configured such that the display device is in complete display mode or in partial display mode.

The control circuit includes a partial display mode line signal generator 2, a partial display mode column signal generator 3, a memory 4 for data to be displayed, and a drive unit 6 for the display cell in complete display mode. The control circuit also includes a clock signal generator 5 for supplying clocking signals CLK to the line signal generator 2, column signal generator 3 and drive unit 6. The clocking signals CLK are defined such that the display cell refreshing frequency at each display cycle tc is close to 75 Hz or less. If the number of lines for active addressing is reduced, this enables the refreshing frequency to be reduced.

In conventional complete display mode, a selection signal PAR_OFF is supplied to drive unit 6 to switch it on, whereas a reverse selection signal PAR_ON is supplied to line and column signal generators 2 and 3 to make them inactive. In this complete mode, the drive unit must address the lines by multiplexing via line control signals ML and the columns by column control signals MC in a conventional manner. The control signals are defined at several voltage levels, for example 5 voltage levels must be provided.

In partial display mode, an active addressing technique is performed. To do this, a selection signal PAR_ON is supplied to line and column signal generators 2 and 3 to make them active, whereas a reverse selection signal PAR_OFF makes drive unit 6 inactive. Line control signal generator 2 is the basis of active addressing in partial display mode. Generator 2 simultaneously generates, for display cell 1, N line control signals for lines L0 to L8, which successively include different N-bit binary words that are different from one period to another as explained above. These line control signals are also supplied to column control signal generator 3 for determining the column control signals. Memory 4, which is for example a non-volatile memory, supplies binary data words for each column. These binary data words are compared in succession to the binary line words to determine column control signals C0 to C68 supplied to display cell 1 for the display of data in the active zone.

A pseudo-random number generator may be used as the line signal generator for active line addressing. For example, for a number N of lines and groups of lines equal to 9, one possible implementation is that shown in FIG. 3.

In FIG. 3, the generator includes a shift register 10 for storing an N-bit binary word, for example a 9-bit word in this embodiment. A bit shift is performed as a function of a clock signal CLK, which clocks the register. A 1-bit data d is introduced into the register at each clock strike CLK. This data d may be logic state 0 for zero voltage or logic state 1 for a voltage Vs that is higher than the display cell threshold voltage, for example for a voltage Vs equal to 1.659·Vth. The time between two rising flanks of clock signal CLK may be time period T of each binary word in the active line addressing operation in partial display mode.

The generator also includes a NOR type logic gate 11 for performing an inverse addition at output of the first 8 bits of the binary word from the shift register. It further includes a first EXCLUSIVE-OR gate 12 for performing an addition of the $5^{th}$ and $9^{th}$ bits of the shift register and supplying a result equal to 0 when the $5^{th}$ and $9^{th}$ bits are identical or equal to 1 when the $5^{th}$ and $9^{th}$ bits are different. Finally, the generator includes a second EXCLUSIVE-OR gate 13 for adding the output state of NOR gate 11 and the output state of the first EXCLUSIVE-OR gate 12, in order to supply data d. This data d has a value of 0 when the input bits are equal and 1 when the input bits are different. Thus, the generator is able to provide line control signals L0 to L8, which are formed of a series of binary words to cover all possible binary word combinations over one complete active addressing cycle. All of the line control signals are orthonormed functions.

Figure 4:
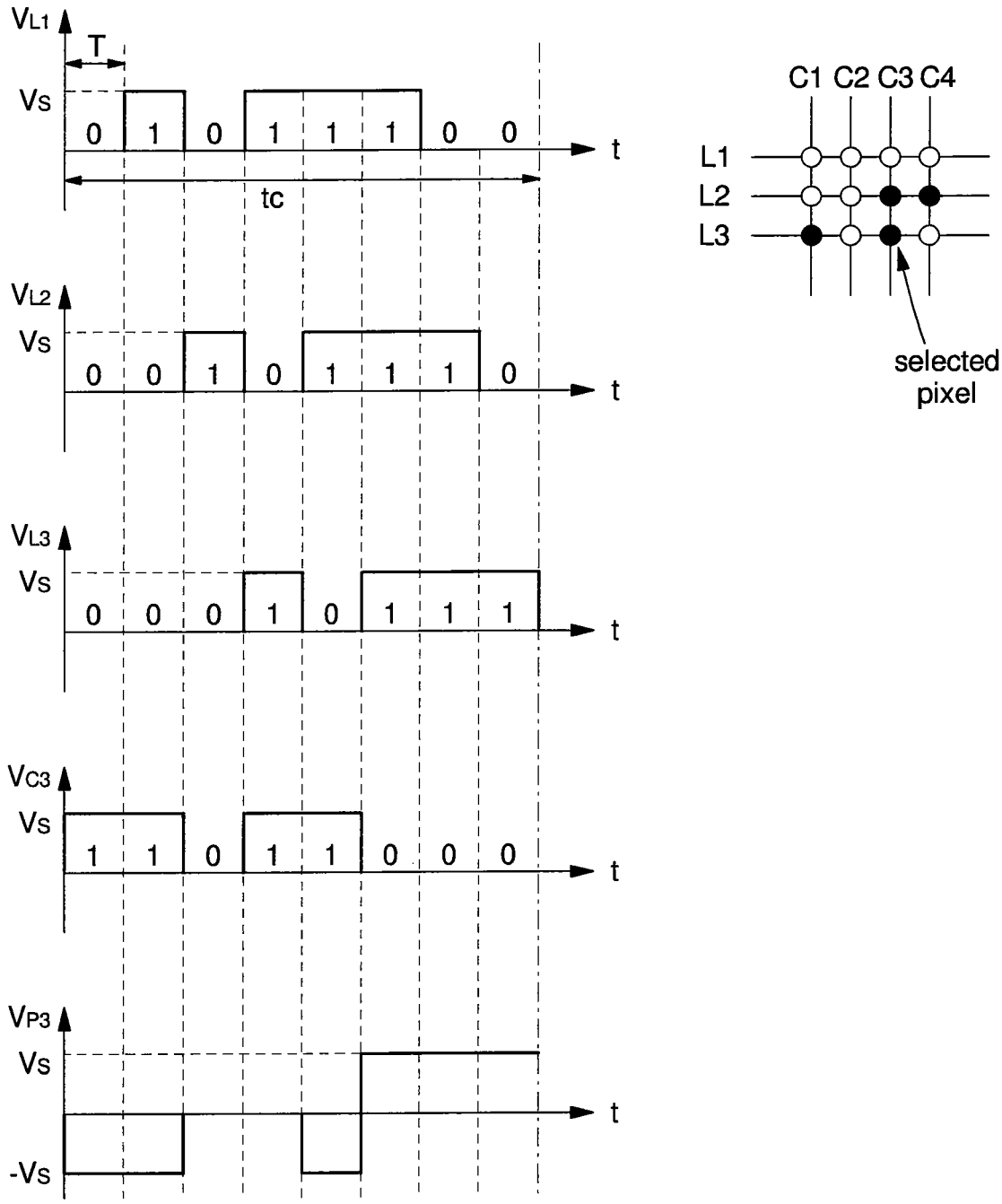
FIG. 4 shows, in a simplified manner, graphs of the line and column control signals obtained, and a polarising signal resulting from one pixel in each active addressing cycle in the partial mode of the display device according to the invention.

In order to understand more simply how the control signal of a column is determined and the polarising voltage of a pixel is chosen by means of active line addressing, reference will now be made to the graphs of FIG. 4. For the sake of simplification, only three lines L1 to L3 are considered for active addressing, and four columns C1 to C4 of the display cell. FIG. 4 shows the desired state of the pixels for displaying data. The white pixels define OFF pixels, whereas the black pixels define ON pixels.

The pixel selected is that which is situated on column C3 and on line L3. The graph of polarising voltage $V_{P3}$ of this selected pixel is shown as the last graph of FIG. 4 as a result of voltages $V_{C3}$ from column control signal C3 subtracted from voltages $V_{L3}$ from line control signal L3.

Over one line addressing cycle tc, the three lines $V_{L1}$, $V_{L2}$, $V_{L3}$ define 8 successive binary words which are all different and which represent all of the binary word combinations from 000 to 111. The length of each binary word is equal to T, which is $2^N$ times less than the length of each cycle tc. For N equals 3, there are thus 8 possible combinations of binary line words.

Control signal $V_{C3}$ of column C3 is thus obtained on the basis of a comparison of the binary word of column C3 and each binary word of the lines. As shown in a simplified manner, column C3 includes a first OFF pixel and two following ON pixels, which gives a binary data word 110. Control signal $V_{C3}$ is obtained by making the comparison bit-by-bit by means of EXCLUSIVE-OR gates between the binary data word of column C3 and each binary line word. In order to do this, account must be taken of the fact that voltage Vs in control signal $V_{C3}$ representing state 1 is only obtained if the number of 1s at the output of the three EXCLUSIVE-OR gates is greater than the number of 0s. Conversely, the zero voltage in control signal $V_{C3}$ representing state 0 is only obtained if the number of 0s at the output of the three EXCLUSIVE-OR gates is greater than the number of 1s.

Figure 5:
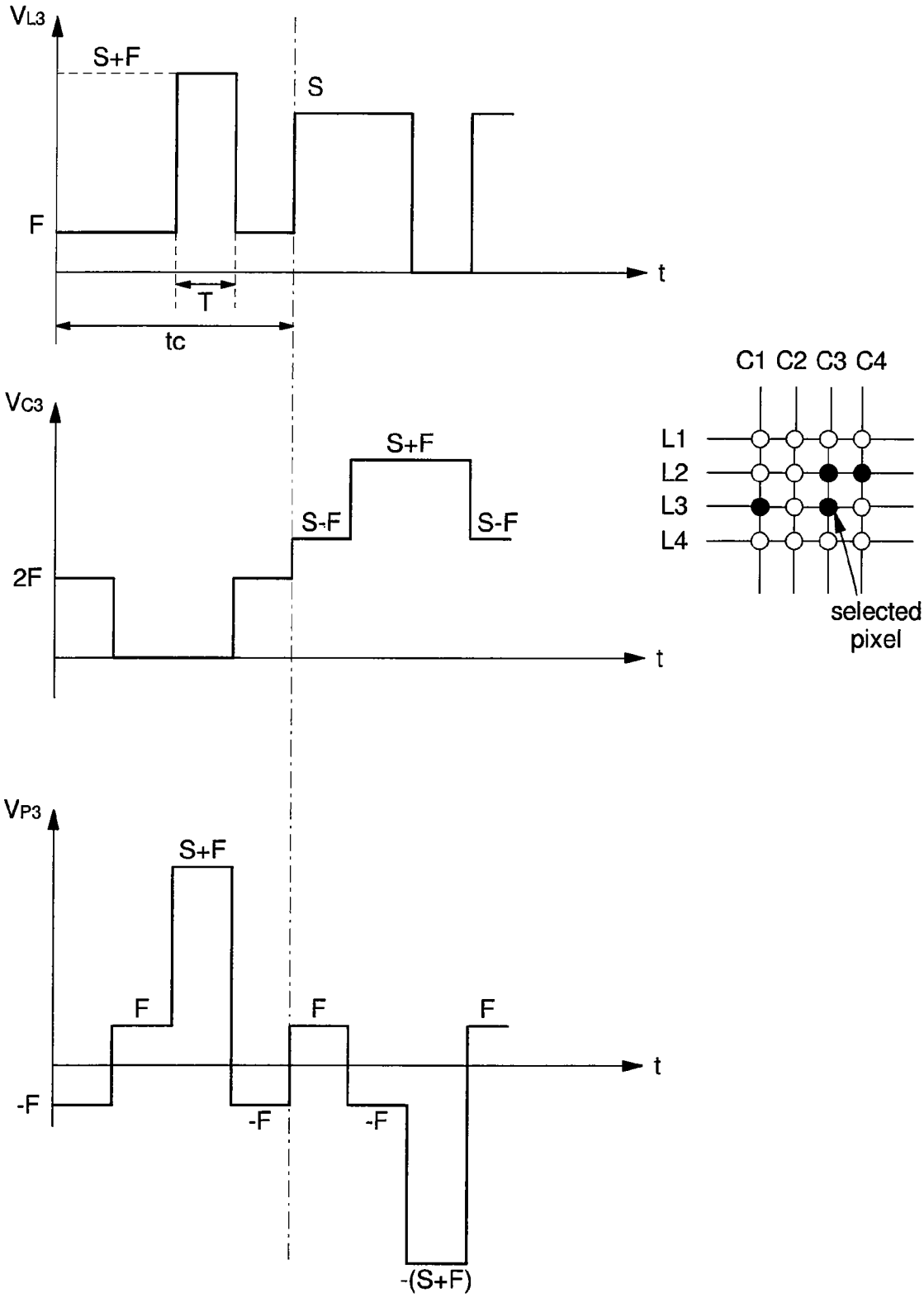
FIG. 5 shows, in a simplified manner, control signal graphs for one line and one column, and the resulting polarising voltage signal of a selected pixel in the conventional complete display mode of the display device according to the invention.

FIG. 5 simply shows graphs of the control signals of a line $V_{L3}$ and a column $V_{C3}$ of a selected pixel, and the resulting polarising voltage when the display device is in complete display mode. For the sake of simplification, the display cell is represented by only 4 lines L1 to L4 and 4 columns C1 to C4, where the ON pixels are black pixels, and the OFF pixels are white pixels. The selected pixel is on line L3 and column C3, and is an ON pixel.

In complete display mode, the lines are addressed by multiplexing in order to be selected one by one per period T. During conventional multiplexing addressing, the series of line addressing cycles of length tc must normally be alternated every other cycle by identical impulse cycles of reverse polarity to remove the continuous voltage component. However, as we wish to work only with voltages above 0 for line and column control signals $V_{L3}$ and $V_{C3}$, a constant voltage F must be added in a first cycle, and a voltage S in a second cycle after the first cycle. The cycles are repeated alternately.

Figure 6:
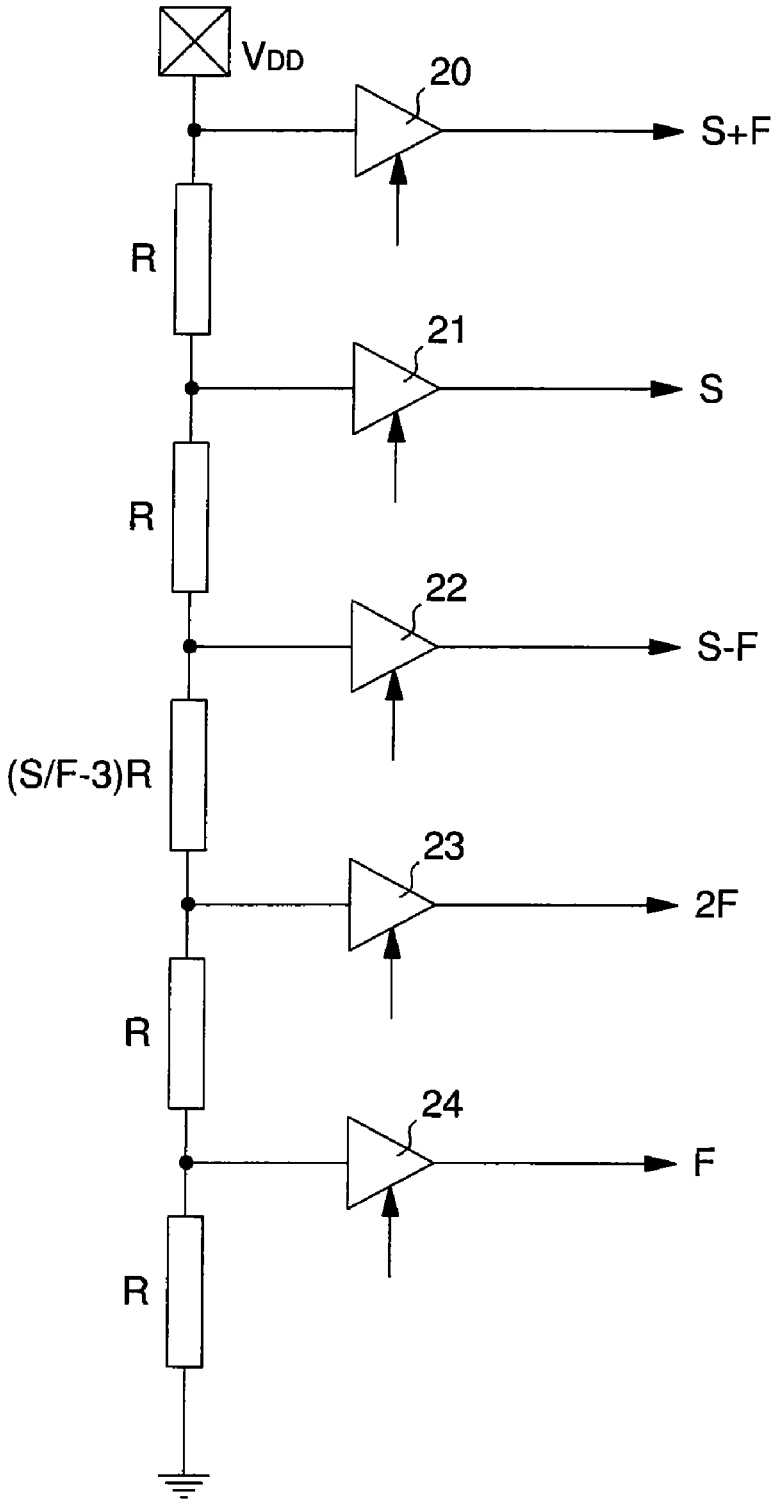
FIG. 6 shows a resistive divider assembly for providing the various voltage levels in the complete display mode of the display device according to the invention.

The different voltages used for generating control signals are represented in a simplified manner by a resistive divider element shown in FIG. 6. Several resistors are series connected between a positive voltage terminal $V_{DD}$ at the output of a voltage booster circuit that is not shown, and an earth terminal. The positive voltage $V_{DD}$ may have a value of more than 5 times the threshold voltage Vth of the display cell, if it includes, for example, 31 lines.

Of the five resistors provided in this resistive divider, four resistors R can have the same value, whereas one intermediate resistor may have a lower or higher value. Follower amplifiers 20 to 24 or switches may be provided, placed at each connection node of two resistors, and at positive terminal $V_{DD}$. These amplifiers can be individually controlled to be active or inactive so as to provide one of the five voltage levels above 0 for generating the different control signals.

A first voltage level F can be provided at the output of amplifier 24. A second voltage level 2•F can be provided at the output of amplifier 23. A third voltage level S-F can be provided at the output of amplifier 22. A fourth voltage level S can be provided at the output of amplifier 21. Finally, amplifier 20 supplies positive voltage $V_{DD}$, which corresponds to voltage S+F. Preferably, to determine voltages S and F, account must be taken of the optimum ratio supplying the maximum contrast between an ON pixel and an OFF pixel. This optimum ratio becomes a maximum for $S/F=N^{0.5}$, where N is the number of lines.

As shown in FIG. 5, the pixel selected is the pixel on line L3 and column C3. Given that only 4 lines are shown for the sake of simplification, 4 line multiplexing operations are performed per cycle tc. The length of each selected line has a value T. The line control signal $V_{L3}$ and the column control signal $V_{C3}$ are shown with the different voltage levels required. Finally, the polarising voltage $V_{P3}$ of the selected pixel is obtained by subtracting column control signal $V_{C3}$ from line control signal $V_{L3}$. It should be noted that the polarising signal is of inverse polarity around 0 V every other cycle. The mean voltage $V_{RMS}$ over each cycle is thus sufficient for the selected pixel to be an ON pixel.

As indicated above, the display device may thus be configured either in complete display mode, or in low power partial display mode. The partial display mode is mainly used, given that it can display at least one line of characters on a restricted active zone of the display cell. In partial mode, the power consumption of the display device is greatly reduced compared to the complete display mode, owing to the active line addressing technique.

From the description that has just been given, those skilled in the art can devise several variants of the display device without departing from the scope of the invention as defined by the claims. One could envisage using this active addressing technique for any type of display device, whether the device has a passive or active matrix. The display cell substrates could be rigid or flexible. One could envisage having an active zone of the configured display device at other places on the display cell different from the central part and moving this programmable active zone.

What is claimed is:

1. A display device including:

(a) a display cell that includes i. a bottom substrate;

ii. a transparent top substrate;

iii. a frame sealing the substrates to define a closed cavity in which there is a substance, wherein optical properties of the substance change in the presence of an electric field; and iv. a matrix of electrodes arranged in lines and columns inside the cavity to define display cell pixels;

(b) a matrix control circuit for the lines and columns for displaying data on the display cell, wherein in complete display mode all of the lines and columns are addressed at several voltage levels by successive line-by-line multiplexing, wherein in low power partial display mode, at least one first group of lines is connected so as to be controlled by the same line control signal from the matrix control circuit, and wherein the lines of an active zone of the display cell and the first group of lines are addressed simultaneously by an active addressing technique at two voltage levels, wherein a first voltage level defines logic level 0 and a second voltage level defines logic level 1, wherein the second voltage level is higher than a threshold voltage of the display device, and the second voltage level is less than two times higher than the threshold voltage.

2. The display device according to claim 1, wherein, in partial display mode, at least one second group of columns is connected so as to be controlled by a same column control signal from the control circuit, and wherein the column control signals of the active zone and of the second group of columns are each determined on the basis of the N line control signals, compared, in one complete cycle, to an N-bit binary data word representative of the state of the pixels of each column.

3. The display device according to claim 1, wherein the lines are placed on a first inner face of one of the substrates, wherein the columns are placed on a second inner face of the other substrate and arranged perpendicularly to the lines so as to define pixels of a passive matrix display cell, and wherein the display cell includes N' lines and M' columns, wherein the number of lines N' is less than the number of columns M' for the complete display mode of the display device.

4. The display device according to claim 2, wherein the number of lines and group of lines actively addressed in partial display mode is an integer number N of between 3 and 11.

5. The display device according to claim 4, wherein the number N is an odd number.

6. The display device according to claim 1, wherein in partial display mode, a number N of lines and groups of lines is simultaneously controlled by N line control signals that include a series of N-bit binary line selection words, wherein the N-bit binary line selection words change every determined period of time, T, so that all of the binary line word combinations are present in each successive cycle of length $2^N \cdot T$.

7. The display device according to claim 1, wherein two groups of adjacent lines are formed in partial display mode with the lines of an active zone arranged between the two groups of connected lines.

8. The display device according to claim 1, wherein two groups of adjacent columns are formed in a partial display mode with the columns of an active zone arranged between the two connected groups of columns.

9. The display device according to claim 1, wherein in low power partial display mode, N line control signals are generated simultaneously by a line control signal generator, clocked by a clock signal, supplied by a clock signal generator.

10. The display device according to claim 9, wherein the line control signal generator includes:

i. a shift register for storing an N-bit binary word and supplying N line control signals;

ii. a NOR logic gate for adding the first N−1 bits and supplying an inverse signal;

iii. a first EXCLUSIVE-OR logic gate for adding two of the N different bits; and iv. a second EXCLUSIVE-OR logic gate for adding together the output of the NOR gate and the output of the EXCLUSIVE-OR gate so as to supply data to the shift register to be inserted at each clock signal.

11. The display device according to claim 3, wherein the number of lines N' is higher than 11 and the number of columns M' is higher than 69.

12. The display device according to claim 6, wherein all of the binary line word combinations consist of $2^N$ different binary words.

13. The display device according to claim 2, wherein two groups of adjacent lines are formed in partial display mode with the lines of an active zone arranged between the two groups of connected lines.

14. The display device according to claim 3, wherein two groups of adjacent lines are formed in partial display mode with the lines of an active zone arranged between the two groups of connected lines.

15. The display device according to claim 4, wherein two groups of adjacent lines are formed in partial display mode with the lines of an active zone arranged between the two groups of connected lines.

16. The display device according to claim 5, wherein two groups of adjacent lines are formed in partial display mode with the lines of an active zone arranged between the two groups of connected lines.

17. The display device according to claim 6, wherein two groups of adjacent lines are formed in partial display mode with the lines of an active zone arranged between the two groups of connected lines.

* * * * *